United States Patent [19]

Thonney

[11] Patent Number: 4,753,046

[45] Date of Patent: Jun. 28, 1988

[54] PROCESS FOR TREATMENT BY BULK AGITATION OF ROUGH CASTINGS OR MACHINED PARTS AND MACHINE FOR IMPLEMENTING THE PROCESS

[76] Inventor: Michel Thonney, Grenade 36, CH - 1510 Moudon, Switzerland

[21] Appl. No.: 796,574

[22] PCT Filed: Feb. 18, 1985

[86] PCT No.: PCT/CH85/00029

§ 371 Date: Oct. 18, 1985

§ 102(e) Date: Oct. 18, 1985

[87] PCT Pub. No.: WO85/03661

PCT Pub. Date: Aug. 29, 1985

[30] Foreign Application Priority Data

Feb. 20, 1984 [CH] Switzerland ..... 808/84

[51] Int. Cl.[4] ..... B24B 31/02

[52] U.S. Cl. ..... 51/164.1; 51/313

[58] Field of Search ..... 51/164.1, 313, 314

[56] References Cited

U.S. PATENT DOCUMENTS

| | | | |
|---|---|---|---|
| 1,422,309 | 7/1922 | Schweinsberg . | |
| 1,510,504 | 10/1924 | Schweinsberg . | |
| 1,835,219 | 12/1931 | Hopkins | 51/164.1 |
| 2,299,032 | 10/1942 | Ransohoff | 51/164.1 |
| 2,359,944 | 10/1944 | Schummer | 51/164.1 |
| 2,509,041 | 5/1950 | Lubenow | 51/314 |
| 2,739,427 | 3/1956 | Ransohoff | 51/164.1 |
| 2,933,861 | 4/1960 | Bintzler | 51/164.1 |
| 3,333,367 | 8/1967 | Salvaire | 51/164 |
| 3,431,684 | 3/1969 | Ban | 51/164 |

FOREIGN PATENT DOCUMENTS

| | | |
|---|---|---|
| 2135052 | 1/1973 | Fed. Rep. of Germany . |
| 53551 | 4/1946 | France . |
| 1387848 | 12/1965 | France . |
| 2192478 | 2/1974 | France . |
| 2325442 | 4/1977 | France . |

*Primary Examiner*—Harold D. Whitehead
*Attorney, Agent, or Firm*—Frost & Jacobs

[57] ABSTRACT

The process allows to treat parts by agitation in a rotary vat having no movable closure member. A machine using such process comprises a rotary vat (101) rotating about a horizontal axis, provided with an axially arranged inlet opening (112), a discharge orifice (115) situated at the periphery of the vat, and a helical baffle (122) for causing a longitudinal displacement of the parts in the treatment chamber (121) of the vat. The vat may be filled during its rotation. It is simply emptied by reversing the rotational direction. The machines of this kind are particularly appropriate for the clipping and the snagging of metal or synthetic castings or for the deburring, degreasing and drying of metal parts.

8 Claims, 3 Drawing Sheets

PROCESS FOR TREATMENT BY BULK AGITATION OF ROUGH CASTINGS OR MACHINED PARTS AND MACHINE FOR IMPLEMENTING THE PROCESS

The present invention relates to a process for treatment by bulk agitation of rough castings or machined parts, wherein these parts are agitated, and possibly mixed with abrasive materials and/or cleaning products in a treatment chamber of a vat in the form of a rotary drum rotating about a horizontal axis.

The invention further relates to a machine for carrying out this process, comprising a vat in the form of a rotary drum rotating about a horizontal axis, a permanently open, axial charging opening, a mechanism for driving said vat, means for controlling said drive mechanism, means for charging parts to be treated into at at least one treatment chamber of the vat, and means for receiving the parts and wastes after treatment.

The treatment of rough castings or machined parts, by agitation in a rotary vat is known and currently applied to more particularly effect clipping and snagging of castings of metal or synthetic material, or else deburring, degreasing and polishing of metallic machined parts obtained by stamping for example. The treatment may be completed by injecting into the vat treating agents for degreasing or washing the parts, then drying the parts. It is further known to effect treatments of this type which are combined with a cryogenic treatment, more particularly by injecting liquid nitrogen, to harden and render certain parts brittle, for example when clipping castings of synthetic material or when deburring elements comprising elastomers.

Most machines utilized for these treatments comprise a vat with a horizontal axis, which presents at least one lateral opening equipped with a door for charging and/or discharging the parts. The presence of a door at the vat periphery nevertheless entails a series of constructive or functional drawbacks. The door represents in particular an important complication with regard to the manufacture of the vat. It comprises locking elements which must be actuated by hand or be specially designed for automatic mechanical actuation, controlled by an adequate device. In the case of cryogenic treatment, thermal insulation of the vat is complicated by the presence of the door and its locking means. On the other hand, halting the vat for charging and discharging must be obtained in given positions, which requires manual or automatic control of the stopping position. In addition, the stationary periods of the vat for charging, discharging, and operating the door have unfavourable repercussions on the productivity.

To meet these drawbacks, machines have been realized with a vat provided with an axial opening, to allow charging and discharging of the parts while the vat rotates, discharge being ensured by a baffle of helical or spiral form which brings the parts to a doorless evacuating opening, when the direction of rotation of the vat is reversed.

French patent FR-A-No. 2,192,478 describes a machine of this type, equipped with a vat with a horizontal axis, comprising a treatment chamber with a peripheral wall which is conical, an axial cylindrical conduit, which is concentric with this treatment chamber and is provided with an integral helical baffle extending up to an axial evacuating opening, and a conduit of spiral form connecting one end of the axial conduit to an opening of the treatment chamber. This opening is located at the periphery of a front wall of the conical treatment chamber, where this chamber presents the largest diameter, so that the parts and the liquid enclosed in the chamber are permanently brought by gravity close to this opening. When the vat rotates in a first direction, the parts are introduced into the axial opening, in which they are axially carried along by the helical baffle towards the spiral conduit, then arrive at the treatment chamber, where they are treated more particularly by agitation and washing. When the direction of rotation of the vat is reversed, the parts and the liquid are evacuated radially by the spiral conduit, then axially by the helical baffle of the axial conduit.

However, the process carried out in this machine presents various drawbacks. In the conical treatment chamber, a major portion of the parts and the treatment liquids is accumulated at one extremity of the chamber and remains in this zone, so that the treatment is not uniform over the whole length of this chamber. Liquids or compressed air can also not be directly sprayed onto the parts during treatment, due to the presence of the axial conduit, so that this machine is not adapted for cryogenic treatment. In addition, discharge of the vat is relatively slow as the parts only pass little by little through the opening connecting the treatment chamber to the spiral conduit, due to the slight conicity of this chamber. Finally, construction of the vat and its conduits is relatively complicated and costly.

The present invention consequently has the object of meeting the drawbacks mentioned above, by providing a process and a machine permitting the treatment of parts by uniform, through agitation, in a rotary vat with a horizontal axis which is of simple construction and may be charged and discharged while it rotates, discharge being operated by inversion of the direction of rotation.

To this end, the process according to the invention is characterized in that the parts are introduced into the vat through a permanently open axial opening, in that the parts are displaced axially within the treatment chamber, in one direction and then in the other, by means of a helical baffle fixed within this chamber, the direction of displacement being determined by the direction of rotation of the vat.

According to a first aspect of the invention, the vat is made to rotate in the direction causing displacement of the parts away from the open extremity of the vat, a batch of parts is introduced, before and/or after the beginning of this rotation, through the open extremity of the vat, rotation of the vat is made to continue for the duration necessary for treatment, the direction of rotation is then reversed, so as to bring the parts back by means of the helical baffle towards an outlet opening disposed close to the open extremity of the vat and to empty the vat solely by this reverse rotation.

According to a second aspect of this process, a vat is employed which comprises two juxtaposed, coaxial treatment chambers that are solid with each other and are each provided with a helical baffle of same sense of helix, the second treatment chamber being of larger section than the first. A bath of parts is introduced into the first chamber through the open extremity, the vat is then made to rotate in a first direction which is effective for maintaining in the first chamber the parts present therein and in emptying the second chamber. The parts are next made to pass from the first to the second chamber by reversing the direction of rotation and the parts are thereby treated in the second chamber, these operations are then repeated with another batch of parts.

According to another aspect of this process, a vat is utilized which comprises several, successive, coaxial treatment chambers which are solid with each other and are each provided with a helical baffle of same sense of helix. The parts are introduced into the first chamber and the vat is made to rotate in a first direction which is effective for maintaining the parts in the chamber wherein they are present and for causing agitation of the parts in the chambers. The vat is next made to rotate in the other direction to make the parts pass from one chamber to the following one and these operations are then repeated.

A machine for carrying out the process according to the invention is characterized in that these parts are introduced into the vat through a permanently open axial extremity, and in that the parts are displaced within the treatment chamber axially in one direction and then in the other, by means of a helical baffle fixed within this chamber, the direction of displacement depending on the direction of rotation of the vat.

The present invention will be better understood with reference to the description of various embodiments, given below by way of example, and to the accompanying drawings, wherein.

Figure 2:
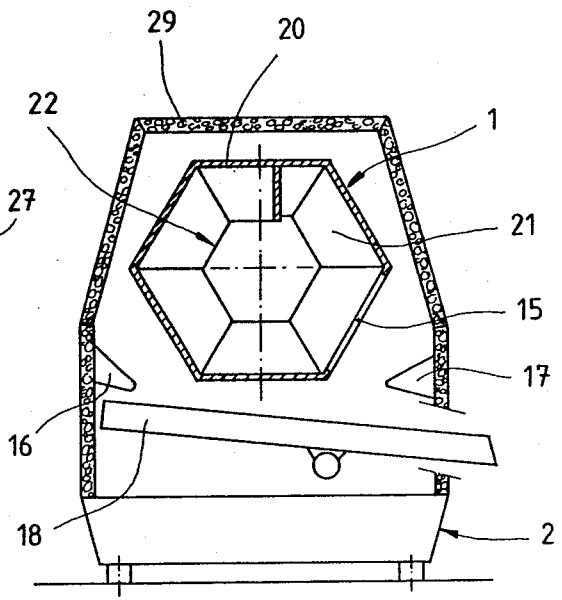
FIG. 2 is a cross-sectional view along line II—II of FIG. 1.
Figure 1:
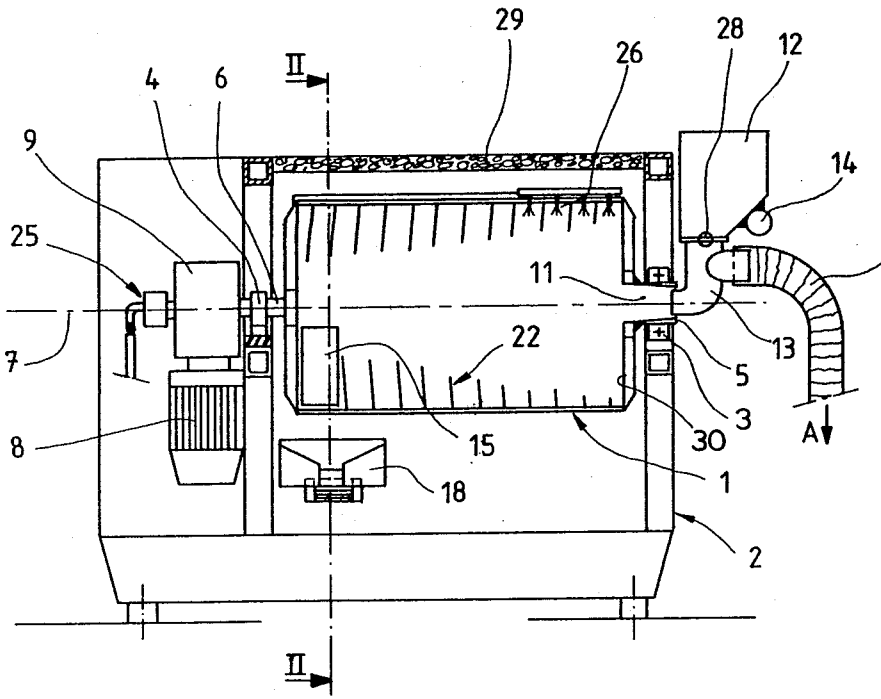
FIG. 1 is a partial longitudinal sectional view of a machine according to the invention, wherein the respective charging and evacuating openings are located at opposite extremities of the vat.

The machine represented in FIGS. 1 and 2 comprises a prismatic vat 1 of hexagonal section. This vat is mounted on a frame 2 by means of bearings 3 and 4 which respectively support journals 5 and 6 solid with each extremity of the vat. The vat 1 can thus rotate about its longitudinal axis 7 disposed in a substantially horizontal position. It is rotatingly driven by means of an electric motor 8 and a reduction gear 9, this motor being connected to control means which are not shown. The interior of the vat 1 constitutes the treatment chamber.

At one of its extremities, situated on the right hand in FIG. 1, the vat comprises a charging orifice 11 disposed axially in the bearing journal 5. A charging hopper 12 comprises, at its bottom part, a bent conduit 13 penetrates into the charging opening 11 to permit introduction of the parts to be treated into the vat 1. The hopper 12 comprises a vibrator 14 which promotes movement of the parts.

The other extremity of the vat presents an evacuating opening 15 which is arranged in its peripheral wall and is permanently open.

However, the size of this opening may be adjusted by partially closing it off with a fixed plate, as a function of the parts to be treated. Underneath the evacuating opening 15, the machine is equipped with deflectors 16 and 17 and with a rocking conveyor 18 for transporting the part towards a receptacle.

As is shown in FIG. 2, the vat presents in cross-section the form of a regular hexagon. Its peripheral casing 20 is thus composed of six plane elements. On their inner face, these elements carry transverse plates 21 arranged radially and contiguously end to end in such a manner as to constitute a helical baffle 22 which extends substantially over the entire length of the vat. In the example represented here, the height of the helical baffle 22 varies progressively along the vat; it is smaller next to the charging opening than next to the evacuating opening. This arrangement favours rapid evacuation of the parts. One may however also provide for a baffle of constant height.

The machine further comprises various auxillary elements which depend on the specific desired treatment. In the represented example, it is equipped with a device 25 for injecting oil which passes within the bearing journal 6 to feed spray nozzles 26 disposed in the vat 1. On the other hand, an exhaust tube 27, connected to the bent conduit 13, permits the evacuation of air and dust, in the direction of the arrow A, from the interior of the vat 1. A pneumatic trap 28 prevents suction of air through the hopper 12.

To limit the propagation of noise produced by agitation of the parts in the vat 1, the machine comprises a sound proofing baffle 9 of noise absorbing material. A sound-proofing coating may be likewise provided on the outer surface of the vat.

The machine illustrated in FIGS. 1 and 2 operates in the following manner. By means of the control means and the motor 8, the vat is made to rotate in a first direction, in which the helical baffle tends to propel the parts longitudinally towards the inlet opening, that is to say towards the right in FIG. 1. Before and/or after having brought the vat to rotation, a batch of parts is introduced into the hopper 12, from which they pass progressively towards the charging opening 11 and the treatment chamber due to the effect of the vibrator 14. Within the vat 1, the parts are agitated in a transversal plane through the rotation of the vat.

At the same time, the helical baffle 22 causes displacement of the parts situated at the periphery towards the inlet opening 11, that is to say towards the right, so that the fill-up level is higher near this opening and that the parts situated nearest to the axis 7 tend to fall back while being displaced towards the left due to an end wall 30 at the end of treatment chamber opposite from the discharge opening 15. The baffle 22 is thus used to produce a displacement of the parts in an axial plane, which is combined with the displacements in the transverse plane to produce an intensive agitation of the parts, whereby each of the parts passes through all zones of the treatment chamber. Thus, if one of the effected treatments is more intensive in one zone than in another, treatment of all of the parts of a batch is nevertheless uniform.

During agitation, the parts are deburred or snagged and/or polished by shocks and by abrasion. They may be mixed with abrasive bodies. They may likewise be subjected to oil spraying by means of the nozzles 36. As a variant, a dry treatment may be effected, with evacuation of dust by the exhaust tube 27.

As soon as the treatment has reached the desired duration, the direction of rotation of the vat is reversed, so that all of the parts it encloses, as well as possibly present liquids and/or abrasive bodies are propelled longitudinally by the baffle 22 up to the evacuating opening 15, through which they fall on to the rocking conveyor 18 whereby to be evacuated. The vat is thus rapidly emptied and may be made to rotate once more in the first direction to carry out a new treatment cycle.

The control means may be advantageously arranged to automatically control the course of the treatment cycle, by acting upon the motor 8, the vibrator 14 and the oil injection device 25, for example according to a cycle having phases of predetermined durations. By disposing an appropriate detector in the vicinity of the evacuating opening 15, for example on the conveyor 18, one may also detect the end of the evacuating phase in order to recommence a new cycle as seen as possible.

Figure 3:
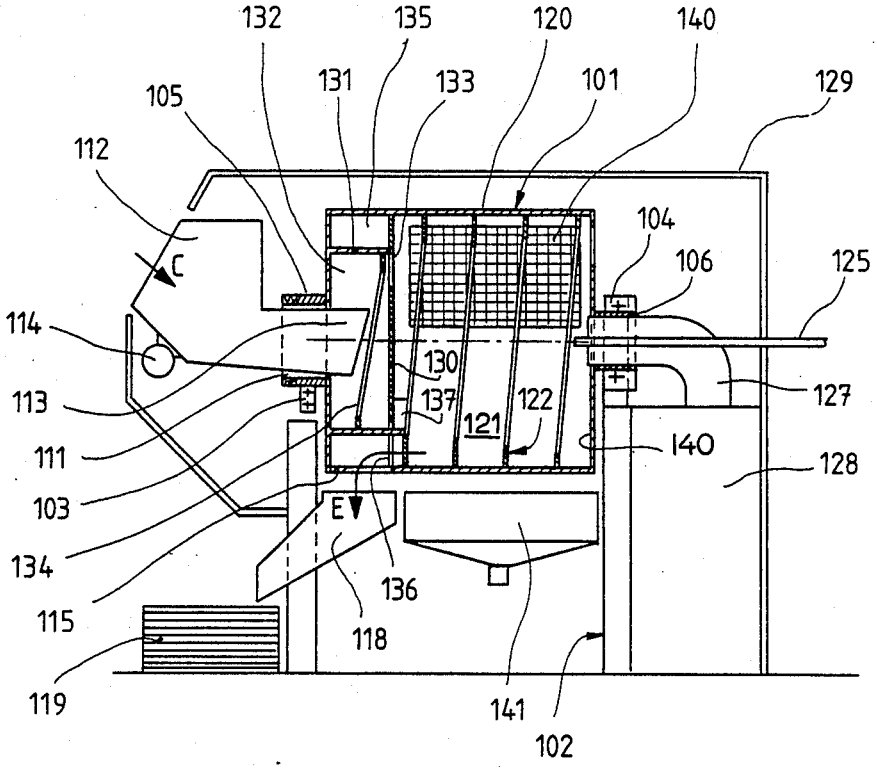
FIG. 3 is a longitudinal sectional view of a machine according to the invention, wherein the respective charging and evacuating openings are located at the same extremity of the vat.

FIG. 3 represents another embodiment of a machine according to the invention, wherein the charging and evacuating openings are situated at the same end of the vat. As in the previous machine, a vat 101 is mounted on a frame 102 by means of bearings 103 and 104 which respectively support journals 105 and 106 solid with the vat. The latter is driven for rotation about is longitudinal axis by means of a drive mechanism, not shown, similar to that of the previous machine. A charging opening 111 of the vat is provided axially in the journal 10j5. The frame 102 supports a charging hopper 112 equipped with a chute 113 which extends into the interior of the vat through the charging opening 111, and with a vibrator 114 for facilitating passage of the parts through the hopper.

At its extremity comprising the charging opening 111, the vat further comprises an evacuating opening 115 provided in its peripheral casing 120. A guide 118 in the form of a funnel is mounted on the frame 102 underneath the evacuating opening 115 for directing the parts going out of the vat towards a mobile receptacle.

At this same extremity, the vat 101 comprises two concentric chamber (132 and 135) which are separated from the remainder of the vat by a transverse wall 130. The two chambers are separated from each other by a cylindrical wall 131 which is coaxial with the peripheral casing 120. The inner chamber 132 is open towards the exterior of the vat through an inlet opening 133 provided in the transverse wall 130. A helical baffle 134 is disposed on the periphery of the inner chamber 132 to direct the parts towards the inlet opening 133.

The outer chamber 135 is of generally annular shape. It is open outwardly through the evacuating opening 115 and towards the interior of the vat through an outlet opening 136 provided in the transverse wall 130.

In the whole remainder of the vat, which constitutes a treatment chamber 121, a helical baffle 122 is disposed against the peripheral casing 120 of the vat. The structure of this baffle is identical with that which has been described with reference to FIGS. 1 and 2. The height of this baffle is the greatest in the vicinity of the evacuating opening 115; it is the least at the other extremity of the vat. To avoid parts being projected through the outlet orifice 136 during agitation, the channel formed by the baffle 122 is covered by a covering plate 137 in the vicinity of the outlet opening.

The sense of the helical baffle 122 is the same as that of the baffle 134 of the inlet chamber.

The machine further comprises various accessory means for effecting complementary treatments, particularly an injection line 125 disposed axially in the journal 106 to permit injection of water or any other liquid into the treatment chamber. An air tube 127, disposed coaxially with the injection line 125 in the journal 106, allows hot air delivered by a compressor 128 to be introduced into the vat to effect drying of the parts in the vat.

To this end, the peripheral casing 120 of the vat comprises screens 140 for the exhaust of air and flow of the liquids into a collecting tank 141 situated under the vat. According to the selected mesh size, the screens 140 likewise allow evacuation of wastes of small size.

To smother the noise produced by agitation of the parts, a sound-proofing baffle 129 surrounds a major part of the machine. In the cases where the vat 101 does not comprise screens 140, it is possible to apply a sound-proofing layer to the outer surfaces of the vat.

Operation of the machine comprises two phases. In a first phase, the vat is made to rotate in the direction in which the helical baffle 122 causes displacement of the parts in the direction away from the open extremity of the vat, that is to say towards the right according to the arrangement of FIG. 3. The parts are dumped in the hopper 112 in the direction of the arrow C and, under the action of the vibrator 114, pass into the chute 113 towards the interior of the vat to fall into the inner chamber 132. In this chamber, they are driven by the rotation of the helical baffle 134 towards the inlet opening 133, where they arrive in the treatment chamber 121. The vat is made to continue rotation in the same direction for the duration necessary for treatment, in the course of which water or any other washing product may be injected into the vat by means of the injection line 125, then drying the parts may be effected by blowing in hot air by the tube 127. An end wall 140 opposite from the discharge opening 136 functions in the same manner as wall 30 in FIG. 1. During this first phase, the hopper 112 and the inner chamber 132 must be completely emptied into the treatment chamber.

In the second phase, when the treatment is terminated, the direction of rotation of the vat is reversed, so as to bring the parts back towards the outlet opening 136 by means of the helical baffle 122. On reaching the outer chamber 135, the parts fall through the evacuating opening 115 as shown by the arrow E. As soon as the vat is completely emptied, the first operating phase may be repeated.

The means for controlling the machine may evidently be designed to automatically control all the necessary operations during a complete operating cycle of the machine according to a predetermined program, such as described above.

Figure 4:
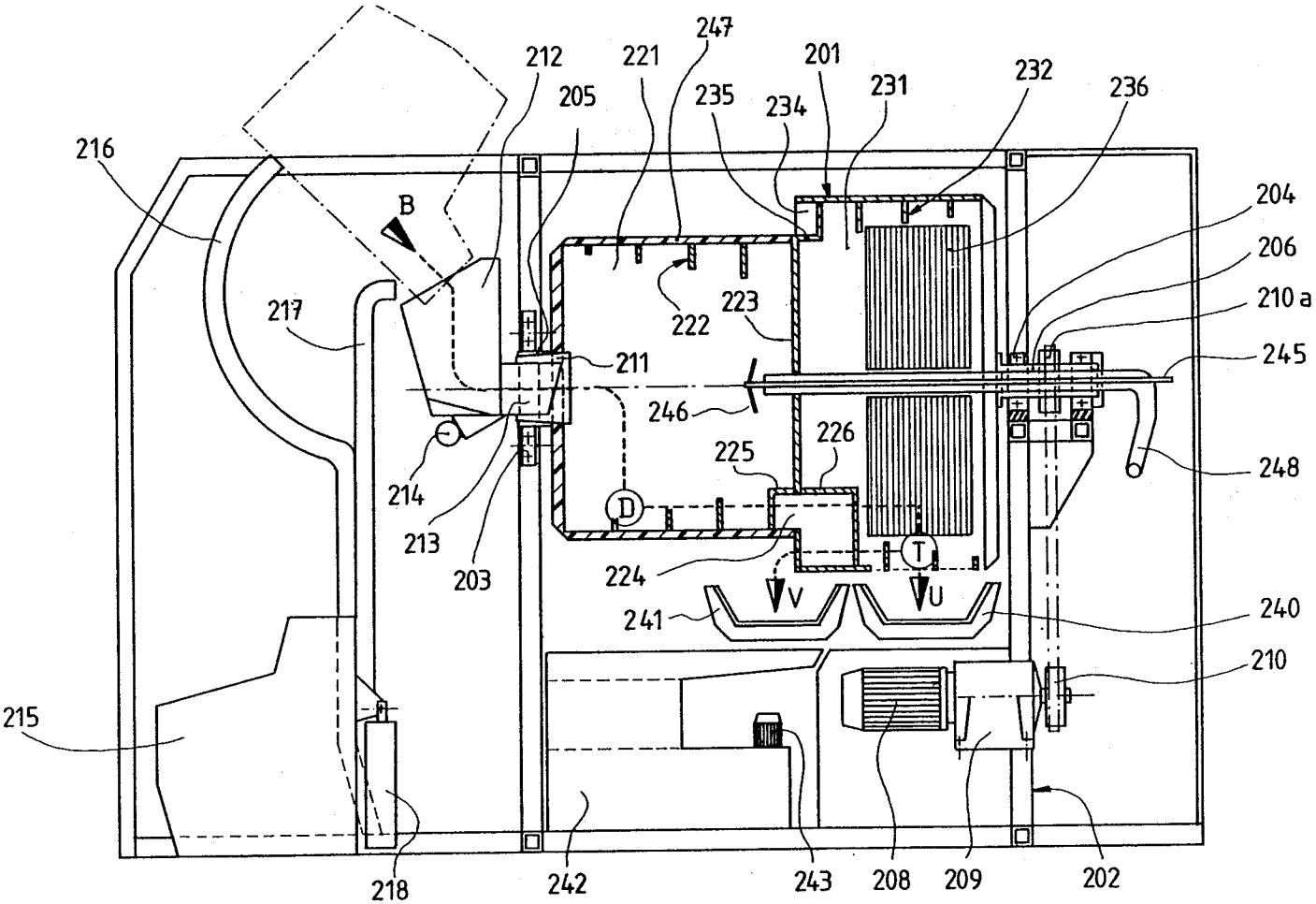
FIG. 4 is a partial longitudinal sectional view of a machine according to the invention, wherein the vat comprises two juxtaposed treatment chambers.

FIG. 4 represents another embodiment of a machine according to the invention, in which a vat 201 comprises two juxtaposed, coaxial treatment chambers 221 and 231 solid with each other.

As in the examples described above, the vat 201 is mounted on a frame 202 by means of bearings 203 and 204 which support journals 205 and 206 respectively solid with each of the extremities of the vat. The vat may thus rotate around its longitudinal axis, the position of which is substantially horizontal. It is rotatingly axis, the position of which is substantially horizontal. It is rotatingly driven by means of an electric motor 208, a reduction gear 209 and pullies 210 and **210*a***.

The machine further comprises a charging hopper 212 provided with a chute 213 which extends into the interior of a charging opening 211 of the vat. The hopper is here likewise equipped with a vibrator 214. On account of its large dimensions, this machine further comprises a charging bucket 215 which slides in guide rails 216 and 217, when it is raised by a hydraulic jack 218, to come to occupy the position drawn in dash-dotted lines corresponding to the position for emptying the bucket 215 into the hopper 212.

The first treatment chamber 221 of the vat 201 is in principle analogous to the vat 1 represented in FIGS. 1 and 2. It is of hexagonal section and comprises, on its lateral inner faces, a helical baffle 222 having a height which increases from the extremity of the vat where the the charging opening 211 is located, that is to say from the left in FIG. 4.

A transverse partition 223 separates the first chamber 221 from the second chamber 231. On one edge, it comprises a transfer opening 224 which allows passage of the parts from one chamber to the other.

The second treatment chamber 231 is of greater section than the first. Its lateral faces comprise a helical baffle 232 of the same sense as the helical baffle 222 of the first chamber. The height of this baffle 232 is maximum near the transverse partition 223 and minimum at the other extremity of the chamber.

The transverse partition 223 extends outwards from the first chamber 221 up to the periphery of the second chamber 231, so as to close off the extremity of the latter on the side of the first chamber. It nevertheless comprises an opening 234 for evacuating from the second chamber, the position of this opening coinciding with the extremity of the helical baffle 232. Near the evacuating opening 234, this baffle is covered by means of a covering plate 235, to avoid parts being projected in an untimely manner out of the vat during agitation. Near the transfer orifice 224, the helical baffles of the two chambers are likewise respectively covered, on the side of the axis, by means of covering plates 225 and 226, which transforms the baffles to conduits closed near the transfer opening 224.

In the represented example, the lateral faces of the vat comprise, in the zone of the second chamber 231, screening grids 236 which allow separation of the parts from their wastes. In this example, the finished parts are metallic injected parts of very small dimensions, which pass through the screening grids 236 to fall into a rocking conveyor 240 for evacuating the parts, while the wastes are injection shanks of relatively large dimensions and are evacuated through the evacuating opening 234 to fall into a rocking conveyor 241 situated beneath this opening. This conveyor is perforated to allow liquid wastes to pass through to a recovering tank 242 situated below and equipped with a pump 243 and a filtering device. The rocking conveyors 240 and 241 may be possibly replaced by conveyor belts.

An injection line 245 is disposed on the axis of the vat through the journal 206 and allows the injection of treating liquids into the first chamber 221 by means of nozzles 246. The injecting liquid may be more particularly liquified nitrogen for cryogenic treatment, which justifies mounting a thermal insulating layer 247 on the outer surface of the vat.

A hot air tube 248, supplied by a device similar to the case of FIG. 3, is further disposed coaxially with the injection line 245, in order to allow drying of the parts in the first chamber.

An operating cycle of the machine represented in FIG. 4 comprises two phases. In a first phase, the vat rotates in the direction in which the helical baffles 222 and 232 cause displacement of the parts to the left, that is to say towards the discharging opening 211 in the first chamber and the evacuating opening 234 in the second chamber. By means of the bucket 215, a batch of rough parts is dumped in the hopper 212 according to arrow B. Due to the action of the vibrator 214, the parts follow the path indicated in dashed lines and progressively fall into the first chamber 221 where they reach the position D. Here, the parts are agitated for the duration necessary for treatment. Rotation of the vat causes agitation of the parts in a transverse plane, while the helical baffle 222 produces a circulation of the parts in a horizontal plane, as previously described with reference to FIG. 1.

Depending on the desired effect, liquid products may be introduced into the vat 201 in the course of treatment by means of the injection line 245 and nozzles 246, for example a product for washing and/or degreasing. The parts may further be dried by means of hot air delivered to the vat by the tube 248. According to another method, the parts may be subjected to a cryogenic treatment by injection of liquid nitrogen.

During this same phase, rotation of the vat 201 causes emptying of the second chamber 231 by means of its helical baffle 232. As this baffle is in fact of same sense as the baffle 222 of the first chamber, it causes displacement of the parts contained in the second chamber towards the left, that is to say towards the evacuating opening 234. If, as previously mentioned, the finished parts have small dimensions and have passed through the screening grids 236 during the preceding cycle, there will remain in the second chamber 231 only the wastes of larger dimensions, which will be evacuated to the rocking conveyor 241 in the course of this first operating phase by following the path indicated by the arrow V. One may further evacuated the liquids injected into the first chamber through the transfer opening 224 or through another opening provided in the partition 223 and equipped with a screen, by stopping rotation of the vat in an adequate position for the liquids to flow through the evacuating opening 234 towards the recovering tank 242 while traversing the perforations of the conveyor 241. The axis of the vat may possibly be disposed in a slightly inclined position to promote evacuation of the water.

Once the required duration of treatment of the parts in the first chamber 221 has been achieved, the direction of rotation of the vat 201 is reversed to accomplish the second phase of operation. The two helical baffles 222 and 232 then cause displacement of the parts to the right according to FIG. 4. The parts contained in the first chamber 221 are progressively propelled by the baffle 222 into the transfer opening 224 and they thus arrive, with their wastes, in the second chamber 231, where the baffle 232 displaces them longitudinally to the right. In the course of this displacement, the parts and the wastes are screened on the screenig grids 236, at the position T. The finished parts, of small dimensions, thus leave the vat 201 according to the arrow U and they fall into the rocking conveyor 240. The wastes of larger dimensions, particularly the injection shanks, are retained in the second chamber 231. This second operating phase lasts for the time necessary to completely empty the first chamber into the second and to effect separation of the parts by means of the screening grids 236. During this time, the bucket 215 may likewise be filled with a new batch of parts to be treated.

The operating cycle of the machine is thus accomplished, while it may be resumed with the first operating phase.

It is evident that, for finished parts of relatively large dimensions, the fabrication may be generally arranged in such a manner as to have wastes of small size and to carry out screening in an inverse fashion with respect to the case mentioned above, by evacuating the parts according to the arrow V and the wastes according to arrow U.

It is understood that the described vats need not necessarily be supported by journals. They may also be supported and driven by rollers, particularly if they have large dimensions.

With respect to known vats with a lateral door, the process according to the invention offers as a principal advantage the possibility of eliminating all doors or other mobile mechanical parts on the vat. Vats may be constructed in a single piece, of simple form and with reduced maintenance. The lateral faces of the vat may all be similar, for rationalizing the construction. It is further particularly simple to realize thermal or sound insulation on the outer vat surface.

On the other hand, as evacuation of the parts from the vat is achieved simply by reversing the direction of rotation, it not only requires no special mechanism, but also allows the use of very simple control means. Emptying the vat may be obtained in a very restricted time, which increases the productivity of the machine.

With respect to the machine described in FR-A-No. 2,192,478, the machine according to the invention is of particularly simple construction, which further allows easy and rapid charging and discharging. In addition, agitation is more effective since longitudinal displacement caused by the helical baffle is combined with the agitation produced in a vertical plane by rotation of the vat, which provides better mixing of the parts. This effect is particularly useful in cases where the parts are mixed with particles of abrasive material.

The realization of a baffle of variable height allows to provide an advantageous effect, particularly in vats where the parts are agitated for prolonged periods, as in the case of FIGS. 3 and 4. The height of the baffle is minimum in the working zone, that is to say the extremity of the chamber towards which the parts are propelled during agitation, in order to limit shocks of the parts on the baffle. The height of the baffle is still just sufficient to empty all of the parts from the vat. At the other extremity of the chamber, the height of the baffle is as great as possible, in order to provide rapid evacuation of the parts when the direction of rotation is reversed.

I claim:

1. Apparatus for treatment of rough castings or machined parts, comprising a vat in the form of a rotary drum rotating about a horizontal axis, a permanently open axial charging opening, a drive mechanism for driving said vat, means for controlling said drive mechanism, means for charging the parts to be treated into at least one treatment chamber of the vat, and means for receiving the parts and/or wastes after treatment, said treatment chamber being of cylindrical or prismatic form and containing at least one helical baffle fixed within the treatment chamber along an inner peripheral surface thereof and arranged to cause displacement of the parts in an axial direction, in one sense or in the other depending on the direction of rotation of the vat, and said vat having at least one permanently open discharge opening situated close to one extremity of said helical baffle, said charging opening and said discharge opening being situated at the same extremity of said treatment chamber, and said helical baffle extending between said discharge opening and an end wall at the opposite extremity of said treatment chamber.

2. Apparatus according to claim 1, wherein said vat comprises at said one extremity provided with the charging and evacuating openings, two concentric chambers which are separated from the treatment chamber by a transverse wall and which are in communication with the treatment chamber, each through a respective opening, the inner concentric chamber comprising said charging opening of said vat and the outer concentric chamber comprising said discharge opening, and a second helical baffle is provided in said inner chamber.

3. Apparatus according to claim 1, wherein said helical baffle of the treatment chamber has, with respect to the inner surface of said chamber, a height which is greater near said discharge opening than at said opposite extremity of the chamber.

4. Apparatus according to claim 1, wherein said vat includes at its periphery screens arranged to separate by screening the wastes from the treated parts.

5. Apparatus according to claim 1, wherein said vat is coated with a thermal insulation layer.

6. Apparatus for treatment of rough castings or machined parts, comprising a vat in the form of a rotary drum rotating about a horizontal axis, a permanently open axial charging opening, a drive mechanism for driving said vat, means for controlling said drive mechanism, means for charging the parts to be treated into at least one treatment chamber of the vat, and means for receiving the parts and/or wastes after treatment, said treatment chamber being of cylindrical or prismatic form and containing at least one helical baffle fixed within the treatment chamber along an inner peripheral surface thereof extending substantially over the entire length of said vat and arranged to cause displacement of the parts in an axial direction, in one sense or in the other depending on the direction of rotation of the vat, and said vat having at least one permanently open discharge opening situated close to one extremity of said helical baffle, said helical baffle extending between said discharge opening and an end wall at the opposite end of said treatment chamber and having, with respect to the inner surface of said chamber, a height which is greater near said discharge opening than at said opposite extremity of the chamber.

7. Apparatus for treatment of rough castings or machined parts, comprising a vat in the form of two coaxial and juxtaposed treatment chambers rotating about a horizontal axis, said chambers being in communication through a transfer opening, a charging opening in the first treatment chamber and a first helical baffle in said first treatment chamber, the second treatment chamber being of greater cross-section than said first treatment chamber and containing a discharge opening, a second helical baffle in said second treatment chamber of the same sense as said first helical baffle, said charging opening being permanently open, a drive mechanism for driving said vat, means for controlling said drive mechanism, means for charging the parts to be treated into said first treatment chamber, and means for receiving the parts and/or wastes after treatment, said treatment chambers being of cylindrical or prismatic form, said first and second helical baffles being fixed within said first and second treatment chambers respectively along an inner peripheral surface thereof extending substantially over the entire length of each chamber and arranged to cause displacement of the parts in an axial direction, in one sense or in the other depending on the directin of rotation of said vat, and said vat having at least one permanently open discharge opening situated close to one extremity of said second helical baffle, said second helical baffle extending between said discharge opening and an end wall at the opposite extemity of said second treatment chamber.

8. Apparatus according to claim 7, wherein said discharge opening is situated close to a transverse partition separating said two treatment chambers.

* * * * *